US007073446B2

(12) United States Patent
Burton

(10) Patent No.: US 7,073,446 B2
(45) Date of Patent: Jul. 11, 2006

(54) ENSURING THE REPEAT LENGTH TO REMAIN THE SAME IN A SEMI-ROTARY DIE CUTTER OR PRINTING PRESS

(75) Inventor: Michael Burton, Bridlington (GB)

(73) Assignee: A B Graphic International Limited (GB)

( * ) Notice: Subject to any disclaimer, the term of this patent is extended or adjusted under 35 U.S.C. 154(b) by 46 days.

(21) Appl. No.: 10/943,731

(22) Filed: Sep. 17, 2004

(65) Prior Publication Data

US 2005/0098052 A1 May 12, 2005

(30) Foreign Application Priority Data

Sep. 18, 2003 (GB) ..... 0321826.0

(51) Int. Cl.
*B41J 1/32* (2006.01)

(52) U.S. Cl. ..... 101/486; 101/216

(58) Field of Classification Search ..... 101/486, 101/483, 216, 232; 83/100, 349; 347/179; 358/1.1

See application file for complete search history.

(56) References Cited

U.S. PATENT DOCUMENTS 3,756,149 A * 9/1973 Bishop ..... 101/228
4,220,084 A * 9/1980 Maclean et al. ..... 101/235
4,579,054 A * 4/1986 Buan et al. ..... 101/91
4,665,353 A * 5/1987 Salazar et al. ..... 318/599
4,909,498 A * 3/1990 Rutishauser ..... 217/10.04
5,018,443 A * 5/1991 Bolger ..... 101/228
5,428,870 A * 7/1995 Rutz et al. ..... 19/240
5,471,928 A * 12/1995 Dimur et al. ..... 101/235
5,813,347 A 9/1998 Baumann ..... 101/486
6,819,346 B1 * 11/2004 Ozaki et al. ..... 347/179

* cited by examiner

*Primary Examiner*—Andrew H. Hirshfeld
*Assistant Examiner*—Wasseem H. Hamdan
(74) *Attorney, Agent, or Firm*—Fay, Sharpe, Fagan, Minnich & McKee, LLP

(57) ABSTRACT

A semi-rotary unit for continuously cutting or printing articles from sheets or from a continuous web, includes a rotary cylinder for supporting about its circumference a removable plate and defining a cutting or printing station, a conveyor for sequentially conveying sheets or a continuous web past the rotary cylinder, and a motor for driving the rotary cylinder and the conveyor. The unit further includes means for determining a correction factor for plates which are originally manufactured for use on a rotary cylinder having a different diameter to that of the unit, and control means for varying the speed of the rotary cylinder relative to the sheets or continuous web in accordance with the correction factor.

16 Claims, 6 Drawing Sheets

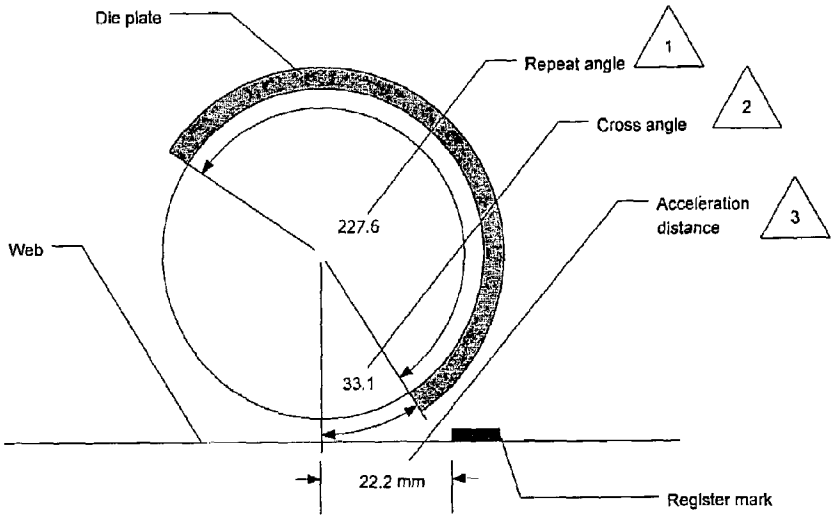
Figure 6(a)
Figure 6(b)
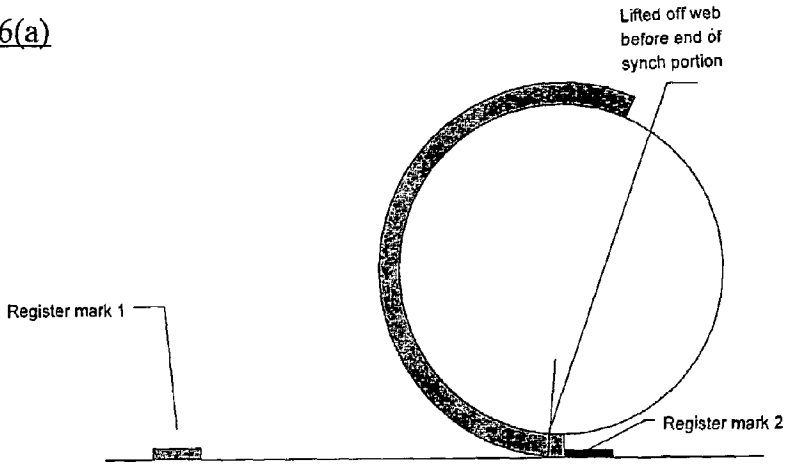
Figure 6(c)

Disproportion = ((S / 3.1415) - (2 * G)) / ((S / 3.1415) - (2 * (G - H)))

ENSURING THE REPEAT LENGTH TO REMAIN THE SAME IN A SEMI-ROTARY DIE CUTTER OR PRINTING PRESS

BACKGROUND

The present invention relates to semi-rotary die cutters and printing presses of the type in which a removable thin die or printing plate is secured to a rotary cylinder.

Semi-rotary die cutters and printing presses are well known in the art and provide a continuously rotating cylinder for repetitive cutting or printing of successive sheets or continuous strip stock. In both applications it is common practise to provide a thin flexible plate which carries the die or print impression on the outer surface thereof and which wraps partially about the rotary cylinder. The die plate or flexographic printing plate is readily removable from the rotary cylinder to allow replacement. Various means have been proposed for releasably securing the plate to the rotary cylinder such as, for instance, vacuum, adhesives, mechanical fasteners and magnetic force.

In a semi-rotary unit sheets or continuous stock strip pass through the unit with a reciprocating or 'Pilgrim step' motion as the rotary cylinder rotates. The rotary cylinder supports over part of its circumference a printing plate or die cutter. The web in such a unit accelerates from standstill to the cutting speed which is the circumferential speed of the rotary cylinder, and then maintains a constant speed while the die knives or impression plate is in contact with the web. When the rotary cylinder has rotated to a position where the die knives or impression plate is no longer in contact, the web decelerates to standstill reverses direction and accelerates and finally decelerates back to standstill. The motion of the web through the unit is such as to ensure that the leading edge of the next repeat is always in the correct start position relative to the rotary cylinder.

For the die plate or flexographic printing plate to continuously match the repeat on the web the speeds of the rotary cylinder and of the web must be exactly synchronised. To this end, each plate is manufactured for use on a rotary cylinder of a particular, known diameter. If the plate is used on a rotary cylinder of a different diameter the repeat length will be altered. This difference may only amount to a few tenths of millimeters, but is enough to affect the quality of the finished product.

If a die or flexographic printing plate is used on a unit having a rotary cylinder with a circumference different to that of the unit for which it was originally intended the print or cut length will not match the web repeat as it should. To overcome this problem either the rotary cylinder must be changed to match the plate or a new plate must be made to match the circumference of the existing rotary cylinder. Neither solution is wholly acceptable as they both involve additional expense on additional cylinders and/or plates and considerable expertise in setting up the machine and bringing it into register on each changeover.

SUMMARY

It is an object of the present invention to provide a semi-rotary die cutter or printing press in which the aforementioned problems and disadvantages are overcome or substantially mitigated.

It is another object of the present invention to provide a semi-rotary die cutter or printing press which can accommodate plates adapted for use on a rotary cylinder having a diameter which is different to that of the cutter or press, such as to ensure that the repeat length thereof remains the same.

According to a first aspect of the present invention there is provided a semi-rotary unit for continuously cutting or printing articles from sheets or from a continuous web, the semi-rotary unit comprising:

i) a rotary cylinder for supporting about its circumference a removable plate and defining a cutting or printing station;

ii) conveyor means for sequentially conveying sheets or a continuous web past the rotary cylinder;

iii) motor means for driving the rotary cylinder and the conveyor means;

vi) means for determining a correction factor for plates which are originally manufactured for use on a rotary cylinder having a different diameter to that of the unit; and v) control means for varying the speed of the rotary cylinder relative to the sheets or continuous web in accordance with the correction factor.

Preferably, the control means controls the speed of the motor means driving the rotary cylinder and/or the conveyor means. Conveniently, the control means takes the form of a software cam shaft and the correction factor is applied to the software camshaft.

In one embodiment of the present invention a correction factor is determined for each of a range of diameters of rotary cylinder and is stored in a look-up table to be accessed when a plate manufactured for use on a rotary cylinder having a diameter other than that of the unit is used. Conveniently, the correction factor for each diameter of rotary cylinder is determined by empirical measurement for each unit. Moreover, the control means may be provided with means for effecting a fine adjustment of the speed of the rotary cylinder relative to the sheets or continuous web to accommodate diameters which fall between the values stored in the look up table.

In a second embodiment of the present invention the correction factor is determined from an algorithm which is based on the variable factors of the unit. These variable factors may include any combination of the following parameters:

i) the diameter of the rotary cylinder for which the plate was originally manufactured for use with;

ii) the height or thickness of the plate;

iii) the axial length of the plate; and vi) the thickness of the sheets or web.

Preferably, the correction factor is obtained by determining:

a) a first disproportion value of the plate pertaining to the rotary cylinder the plate was originally manufactured for use on;

b) the plate length after applying the first disproportion value;

c) a second disproportion value of the plate pertaining to the rotary cylinder of the unit;

d) the plate length after applying the second disproportion value;

e) the proportion of the rotary cylinder of the unit covered by the plate;

f) the compensated cylinder circumference; and finally subtracting the cylinder circumference of the unit from the compensated cylinder circumference.

According to a second aspect of the present invention there is provided a process for operating a semi-rotary unit for continuously cutting or printing articles from sheets or from a continuous web, the process comprising:

a) passing said sheets or web sequentially through a rotary cutting or printing station having a rotary cylinder for supporting about its circumference a removable plate b) determining a correction factor for plates which are originally manufactured for use on a rotary cylinder having a different diameter to that of the unit; and c) varying the speed of the rotary cylinder relative to the sheets or continuous web in accordance with the correction factor.

BRIEF DESCRIPTION OF DRAWINGS

An embodiment of the present invention will now be described, by way of example, with reference to the accompanying drawings in which:

FIGS. 6(*a*), (*b*) and (*c*) show the positions of a die cutter relative to a continuous web at different points in the cutting cycle and illustrates how the die cutter is lifted from the web before the end of the synchronous speed part of the cycle if it does not match the circumference of the rotary cylinder.

DETAILED DESCRIPTION

Figure 1:
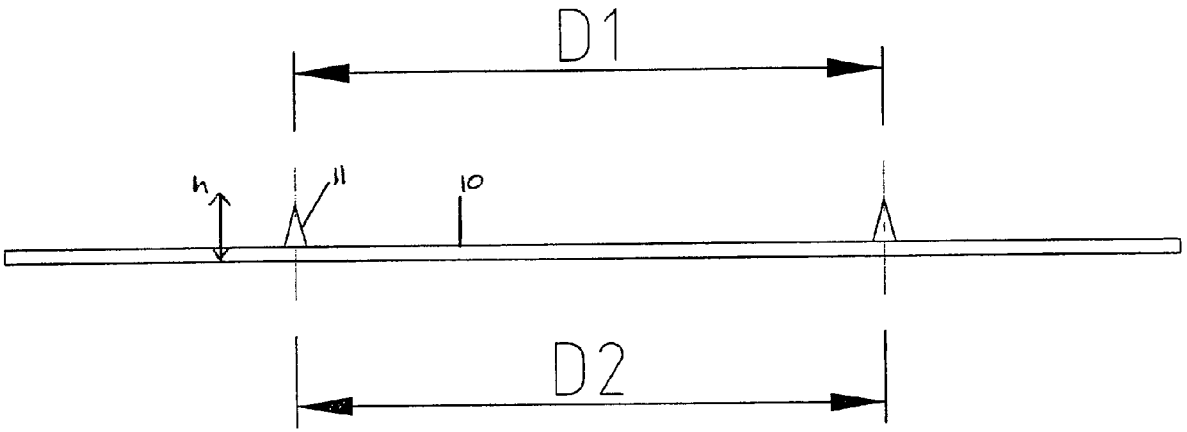
FIG. 1 is a side section of a die plate for use in a semi-rotary die cutting unit laid flat.
Figure 2:
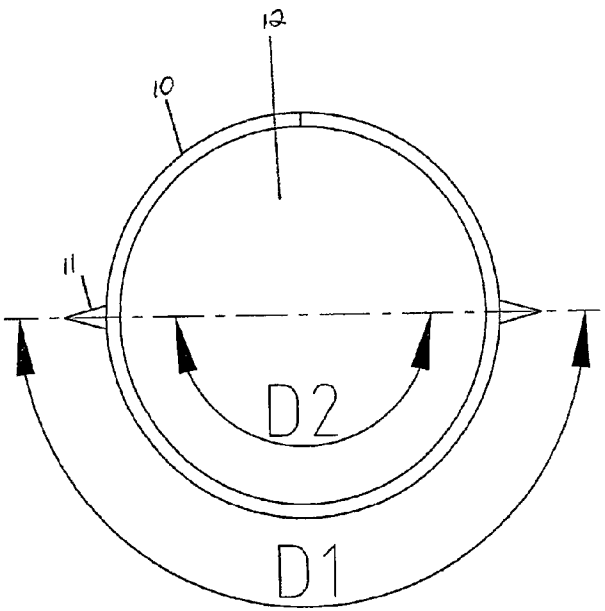
FIG. 2 is a side section of the die plate show in FIG. 3 wrapped around a cylinder.

When a die plate or a flexographic printing plate is unwrapped from a magnetic die cylinder or print cylinder and laid on a flat surface the length of the plate will be shorter than the nominal repeat length thereof. Referring to FIG. 1 there is shown a side section of a plate 10 supporting cutting blades 11. The plate is laid flat and it can be seen that the distance $D_1$ between the top of the blades 11 is equal to the distance $D_2$ between the bottom of the blades 11. Referring to FIG. 2, the same plate 10 is shown wrapped around a cylinder 12. This causes the top points of the cutting blades 11 to move further apart, with the result that the distance $D_1$ is greater than the distance $D_2$. The difference between $D_1$ and $D_2$ is proportional to the height (h) of the plate 10 and cutting blades 11. This factor has to be accounted for in any plate that is made for a cylinder of a particular circumference. A plate must have this factor applied for the print or cut length to be correct. In a full rotary flexo printing or die cutting unit, the cylinder and plate size will match each other and therefore different die/print cylinders must be used for each job.

Figure 3:
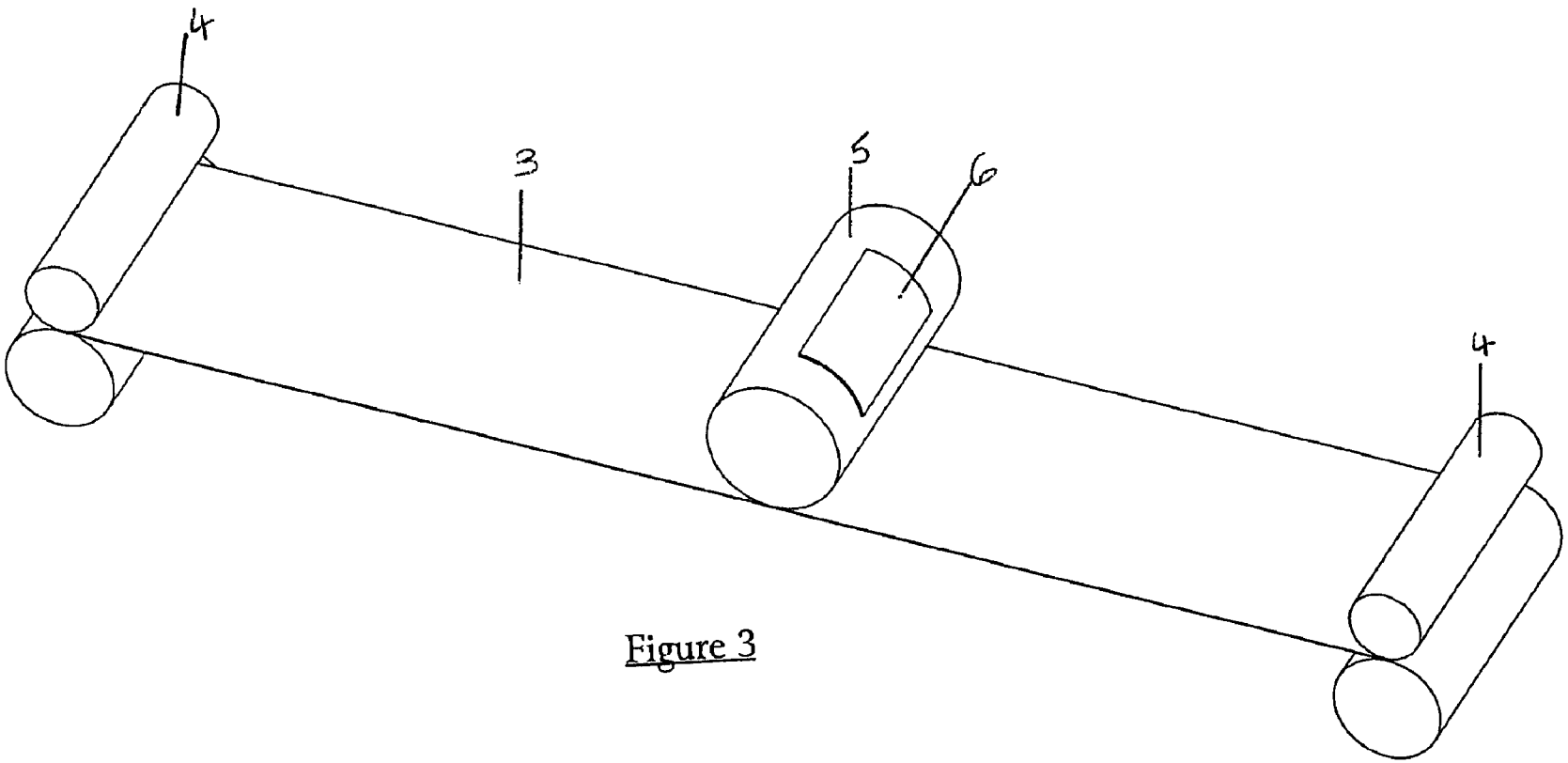
FIG. 3 is a schematic diagram of the main components of a semi-rotary die cutting unit.
Figure 4:
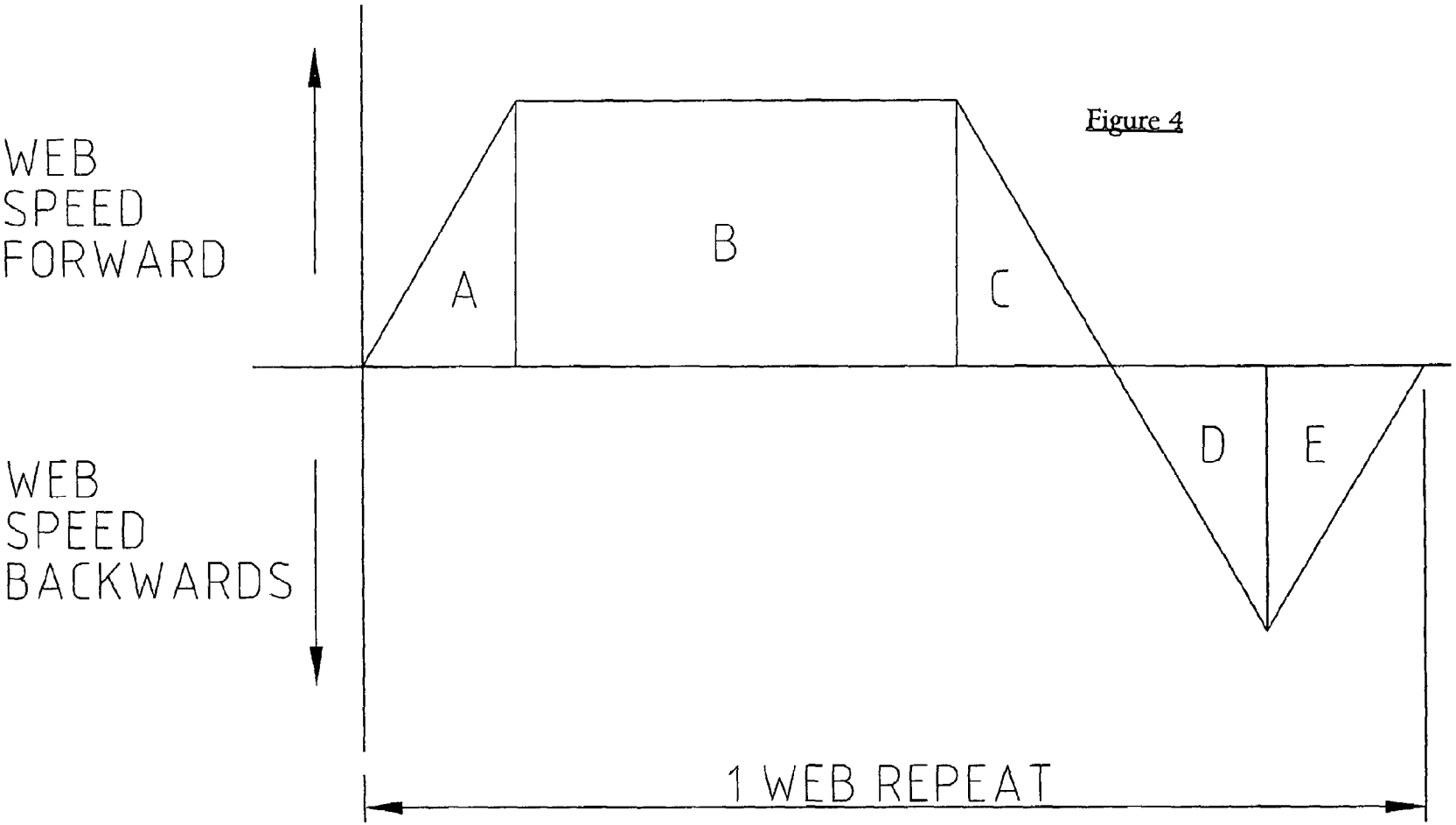
FIG. 4 is a graph showing the web velocity as it moves with a reciprocating motion through a semi-rotary die cutting unit.

To overcome the time, effort and cost involved in changing from one job to another a range of machines have been developed that use a semi-rotary action. This involves using only one cylinder to mount the die or printing plates and the web is moved backwards and forwards underneath the cylinder using a 'Pilgrim step'. Referring to FIG. 3 the main components of a semi-rotary unit operating on a continuous web are shown. The continuous web 3 is supported at each end of the unit by draw rollers 4 and these cause the web to move past a rotary cylinder 5 as it turns at a constant speed. The rotary cylinder 5 supports over part of its circumference a printing plate or die cutter 6. The rotary cylinder 5 turns at a constant speed and the web 3 is moved underneath it with a controlled motion to cut or print the web 3. The motion of draw rollers 4 and the rotary cylinder 5 must be closely controlled and linked to each other to perform the operation correctly. The web motion for such a machine is shown in FIG. 4. The web accelerates from standstill to the cutting speed (area A), which is the circumferential speed of the die cylinder, and then maintains a constant speed (area B) while the tool is in contact with the web. When the cylinder has rotated to a position where the web and tool are no longer in contact with each other the web decelerates to a standstill (area C), reverses direction and accelerates (area D) and finally decelerates back to standstill (area E). The areas of A, C, D and E are arranged to be identical to each other and therefore cancel each other out which brings the leading edge of the next repeat into the correct start position. The web motion of acceleration, constant speed, deceleration, reverse acceleration and reverse deceleration are all accomplished in one revolution of the rotary cylinder. For the rotary cylinder to match the repeat on the web the speeds of the cylinder and web must be exactly synchronised. This method of operation still requires that a compensation factor is applied to the plate to make the cut/print correct.

A semi-rotary machine is configured to draw the length of the web repeat underneath the die cylinder as the die plate rotates around bottom dead centre. Currently a servo motor is normally used to drive each individual draw roller and cylinder with the motion of each being linked together with a software camshaft. The system software is passed parameters relating to the circumference of the infeed and outfeed draw rollers, the circumference of the die cylinder, the physical gear ratios of each and the printed web repeat length. From these values a software cam is calculated to link the motion of the draw rollers to that of the die cylinder. The proportion of the die cylinder that is covered by the plate is the distance that the web must run at the same speed as the surface speed of the die cylinder. This distance is known as the 'Web repeat angle'. The acceleration, deceleration and reversing of the web are split into four equal periods taking up the remaining rotation of the die. The distance that the cylinder turns through in this time is known as the 'Cross angle'.

$$\text{Web repeat angle}=(\text{Die plate length}/\text{Die cylinder circumference})*360$$

$$\text{Cross angle}=(360-\text{Web repeat angle})/4$$

The leading edge of the die plate is always mounted in a known position on the cylinder and the web and cylinder are both positioned at the start of the cycle such that they are both the cross angle distance from the bottom dead centre position of the die cylinder.

Figure 5B:
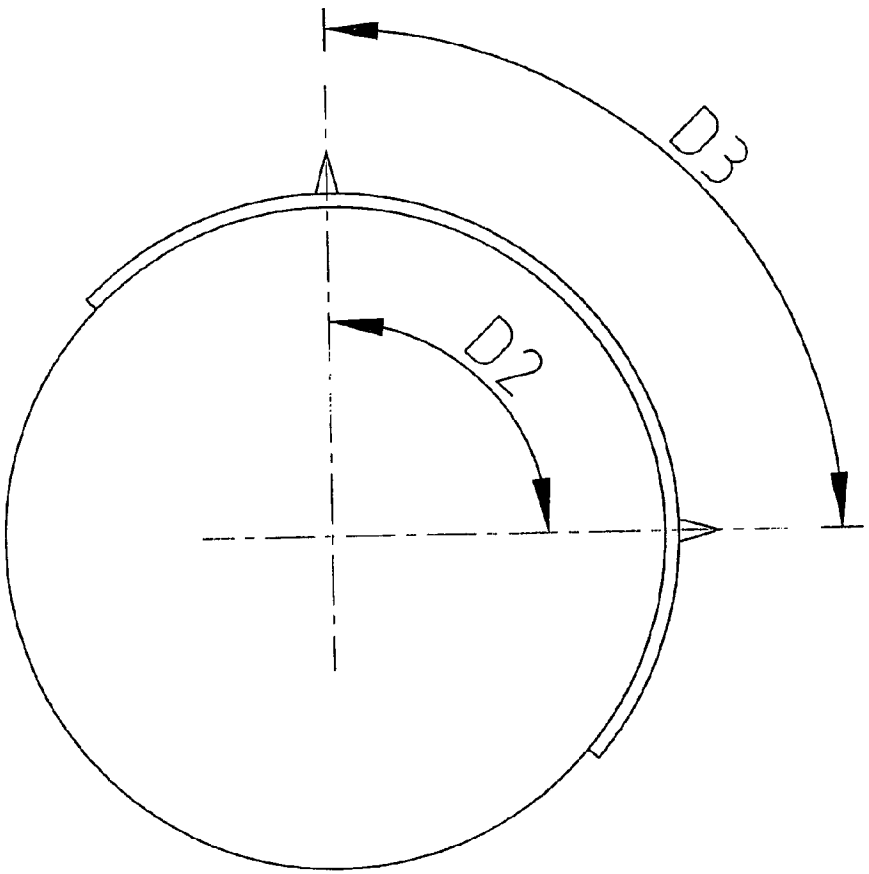
FIGS. 5(*a*) and (*b*) show how the cutting length of a die plate changes when it is transferred from a cylinder of one diameter to a cylinder of another large diameter.
Figure 5A:
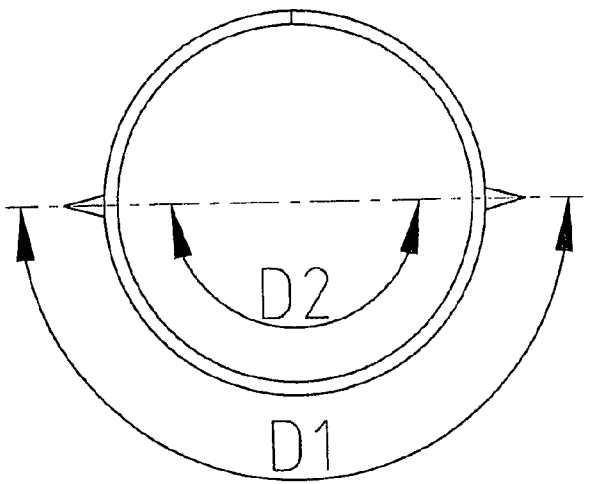

If a die or printing plate is used that is made for a machine with a different circumference cylinder, the print or cut will not match the web repeat as it should. FIGS. 5(*a*) and (*b*) show what happens if a plate for a full rotary cylinder (a) is used on the larger semi-rotary die (b). In (a), the distance $D_1$ will be the correct web repeat when used on the cylinder it was designed to fit. However, when the same plate is used on the larger cylinder shown in (b) the distance $D_3$ is shorter than $D_1$, giving rise to a shorter web repeat.

A software cam is calculated such that the draw rollers 4 are linked to the rotary cylinder 5 and perform the motion profile that is shown in FIG. 4. The draw rollers 4 are linked to the motion of the rotary cylinder 5 so that the web and the surface of the die are running at the same speed when the web is in contact with the die tool. The cam calculation ensures that the area B (web repeat length) from FIG. 4 is pulled through the machine during the period of the die rotation where the plate is mounted (Web repeat angle). An adjustable factor can now be built into the software cam to manipulate the start point and length of synchronisation of the web in relation to the die. This will then pull the correct length of material through the machine in a shorter period of the die cylinder rotation. This has the effect of lengthening the cut of the die plate to match the correct web repeat. In this way plates that are not correctly compensated for the die cylinder during manufacture can be adjusted electronically to produce the correctly sized product.

The cylinder start position is adjusted to the value of the cross angle and the web start position is the acceleration distance in front of the cylinders bottom dead centre position (FIG. 6(*a*)). As the die cylinder rotates through the cross angle the web accelerates up to synchronous speed (FIG. 6(*b*)). At the end of the synchronous portion of the cycle the die has cut the required web repeat and is about to leave contact with the web (FIG. 6(*c*)).

Repeat angle=Web repeat*(360/Cylinder circumference)

Cross angle=(360−Repeat angle)/4

Acceleration distance=((Web repeat/Repeat angle)*Cross angle)/2

If a tool designed for a full rotary cylinder is placed on the die cylinder with the front edge aligned at the correct plate mounting position, the plate does not cover the expected portion of the cylinder circumference. This has the effect of lifting the tool from the material before the end of the synchronous speed part of the cycle. This leads to larger gaps than required between the cut or printed frames on the web. As the software uses the die circumference to calculate the software cam the compensation factor can be applied here to make the feed rollers pull the correct amount of material through the machine while the 'short' plate is in contact with the web. Once the factor is added in the system will recalculate the repeat angle, cross angle and acceleration distance to account for the apparent increase in the cylinder diameter.

The formula used for calculating the disproportion of a die tool is:

$$D=((S-(2*G*\pi))/(S-(2*(G-H)*\pi)))*100$$

where:

D=disproportion percentage.

S=cylinder size—the circumference of the bearers of the full rotary cylinder (generally the repeat length of the printed web to be cut).

G=cylinder step—depth difference between the bearers and the magnetic part of the cylinder.

H=tool height—the distance from the back of the plate to the top of the cutting blade.

Figure 7:
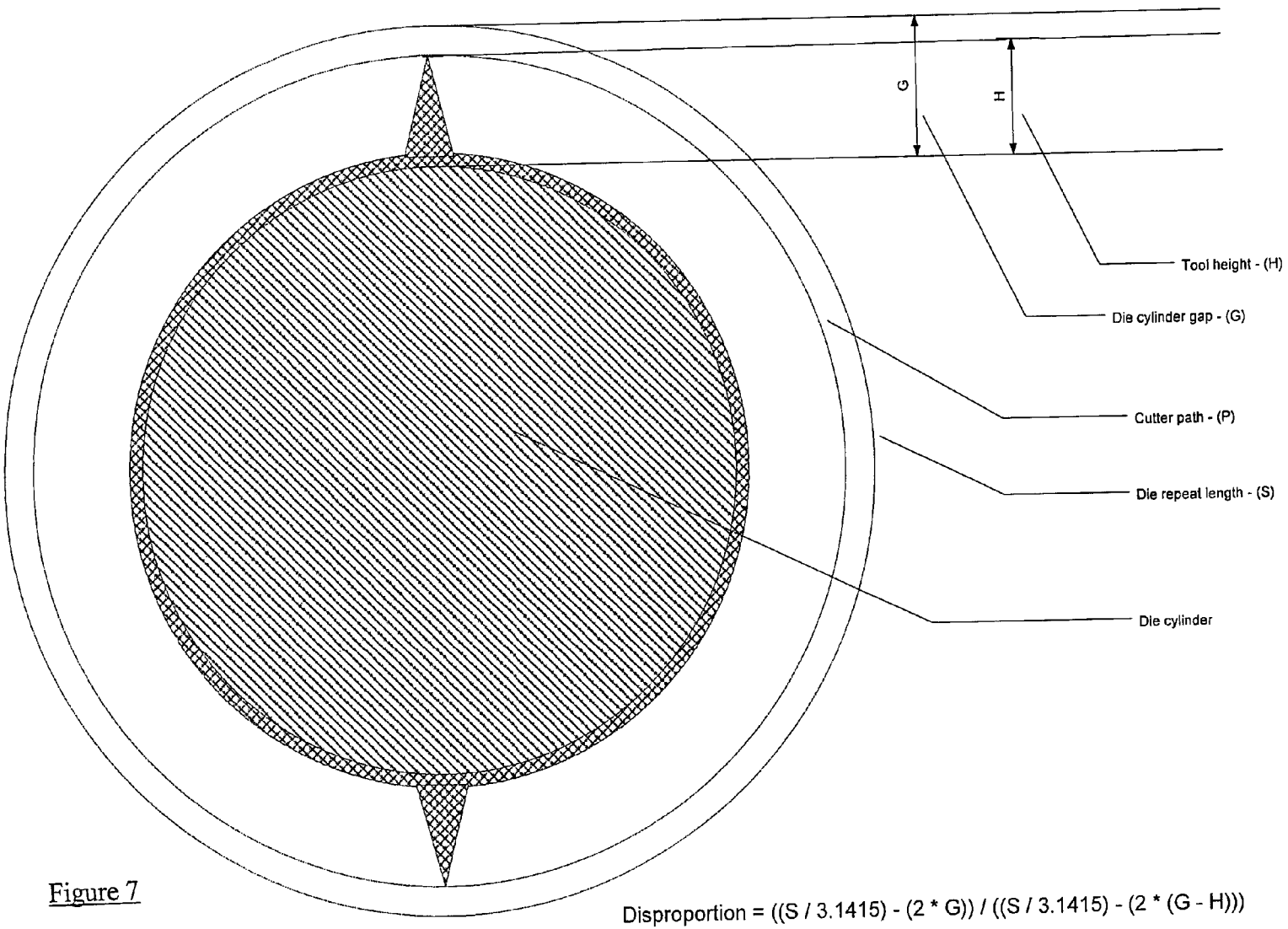
FIG. 7 shows a rotary cylinder carrying a die cutter and illustrates how the disproportion value is calculated.

In simple terms this is the ratio of the circumference of the magnetic part of the cylinder that the plate is attached to and the circumference of the circle described by the tip of the cutting blade on the plate (FIG. 7).

Using the disproportion value and the nominal cut length of the tool the length of the plate can be calculated. If this plate is put on the semi-rotary cylinder the proportion of the cylinder surface that is covered can be calculated. This is the repeat angle taking into account the actual plate length (P) and die step size (G).

P=Plate length

L=Nominal cut length of plate

A=Angle of semi-rotary cylinder covered by plate (repeat angle)

$$P=(L*D)/100$$

$$A=(P/(S-(2*G*\pi)))*360$$

If a plate that is disproportioned for a different sized cylinder is used then the plate length is incorrect and the angle that is covered by the plate is less than it should be. The correction factor for the die circumference can be calculated using the actual repeat angle and the plate length for a correctly disproportioned tool. As the angle of the cylinder that is covered by the plate is smaller, the cut length is shortened and the repeat angle must be reduced.

If $\#_1$ is used to describe the value for the actual plate and $\#_2$ is used to describe a correctly disproportioned plate then:

$$P_1=(L*D_1)/100$$

$$A_1=(P_1/(S-(2*G*\pi)))*360$$

and $$P_2=(L*D_2)/100$$

We now need to calculate what size the cylinder would need to be to have a repeat angle of $A_1$ if the plate that was fitted to it was of the length $P_2$. This cylinder circumference is denoted as $S_3$ $$A_1=(P_2/(S_3-(2*G*\pi)))*360$$

rearranging the equation gives us $$(A_1/360)=P_2/(S_3-(2*G*\pi))$$

$$S_3-(2*G*\pi)=P_2/(A_1/360)$$

$$S_3=(P_2/(A_1/360))+(2*G*\pi)$$

The correction factor required to be added to the die circumference (F) is thus $$F=S_3-((P_2/(A_1/360))+(2*\pi*G))$$

Definitions:

Full rotary cylinder circumference—$S_1$

Disproportion percentage for full rotary tool—$D_1$

Plate length for full rotary tool—$P_1$

Cylinder step—G

Tool height—H

Semi-rotary cylinder circumference—$S_2$

Disproportion percentage for semi-rotary tool—$D_2$

Correct plate length for semi-rotary tool—$P_2$

Actual angle of semi-rotary cylinder covered by plate—$A_1$

Angle of semi-rotary cylinder covered by correctly disproportioned plate—$A_2$

Compensated semi-rotary cylinder circumference—$S_3$

Disproportion compensation factor—F

Cut length of plate (web repeat)—L

The following steps are used to calculate the compensation factor.

Calculate the disproportion for the semi-rotary cylinder $$D_2=((S_2-(2*G*\pi))/(S_2-(2*(G-H)*\pi)))*100$$

Calculate the plate length for a correctly disproportioned plate $$P_2=(L*D_2)/100$$

Calculate the disproportion of the plate to be used using the original cylinder size $$D_1=((S_1-(2*G*\pi))/(S_1-(2*(G-H)*\pi)))*100$$

Calculate the actual plate length $$P_1=(L*D_1)/100$$

Calculate the proportion of the semi-rotary cylinder that is covered by the plate $$A_1=(P_1/(S_2-(2*G*\pi)))*360$$

The compensated cylinder circumference can be calculated from $$S_3=(P_2/(A_1/360))+(2*G*\pi)$$

The disproportion compensation factor is $$F=S_3-S_2$$

EXAMPLE

| | |
|---|---|
| Full rotary cylinder circumference ($S_1$) | 304.8 mm (12 inches) |
| Semi-rotary cylinder circumference ($S_2$) | 482.6 mm (19 inches) |
| Cylinder step size (G) | 0.48 mm |
| Tool height (H) | 0.44 mm |
| Cut length (L) | 304.8 mm (12 inches) |

Disproportion for the semi-rotary cylinder $$D_2 = ((S_2 - (2*G*\pi))/(S_2 - (2*(G-H)*\pi)))*100$$

$$D_2 = ((482.6 - (2*0.48*\pi))/(482.6 - (2*(0.48-0.44)*\pi)))*100$$

$$= 99.427\%$$

Correct plate length $$P_2 = (L*D_2)/100$$

$$P_2 = (304.8*99.427)/100$$

$$= 303.053 \text{ mm}$$

Disproportion of the original cylinder $$D_1 = ((S_1 - (2*G*\pi))/(S_1 - (2*(G-H)*\pi)))*100$$

$$D_1 = ((304.8 - (2*0.48*\pi))/(304.8 - (2*(0.48-0.44)*\pi)))*100$$

$$= 99.092\%$$

Actual plate length $$P_1 = (L*D_1)/100$$

$$P_1 = (304.8*99.092)/100$$

$$= 302.032 \text{ mm}$$

Proportion of the semi-rotary cylinder that is covered by the plate $$A_1 = (P_1/(S_2 - (2*G*\pi)))*360$$

$$A_1 = (302.032/(482.6 - (2*0.48*\pi)))*360$$

$$= 226.72$$

Calculate the corrected cylinder circumference $$S_3 = (P_2/(A_1/360)) + (2*G*\pi)$$

$$S_3 = (303.053/(226.72/360)) + (2*0.48*\pi)$$

$$= 484.22$$

Compensation factor $$F = S_3 - S_2$$

$$= 484.22 - 482.6$$

$$= 1.62$$

The invention claimed is:

1. A semi-rotary unit for continuously cutting or printing articles from sheets or from a continuous web, the semi-rotary unit comprising:

i) a rotary cylinder for supporting about its circumference a removable plate and defining a cutting or printing station;

ii) conveyor means for sequentially conveying sheets or a continuous web past the rotary cylinder;

iii) motor means for driving the rotary cylinder and the conveyor means;

vi) means for determining a correction factor for plates which are originally manufactured for use on a rotary cylinder having a different diameter to that of the unit; and v) control means for varying the speed of the rotary cylinder relative to the sheets or continuous web in accordance with the correction factor.

2. A semi-rotary unit according to claim 1, wherein the control means controls the speed of the motor means driving the rotary cylinder and/or the conveyor means.

3. A semi-rotary unit according to claim 2, wherein the control means takes the form of a software camshaft and a correction factor is applied to the software camshaft.

4. A semi-rotary unit according to claim 2, wherein a correction factor is determined for each of a range of diameters of rotary cylinder and is stored in a look-up table to be accessed when a plate manufactured for use on a rotary cylinder having a diameter other than that of the unit is used.

5. A semi-rotary unit according to claim 2, wherein the correction factor is determined from an algorithm which is based on the variable factors of the unit.

6. A semi-rotary unit according to claim 1, wherein the control means takes the form of a software camshaft and a correction factor is applied to the software camshaft.

7. A semi-rotary unit according to claim 6, wherein a correction factor is determined for each of a range of diameters of rotary cylinder and is stored in a look-up table to be accessed when a plate manufactured for use on a rotary cylinder having a diameter other than that of the unit is used.

8. A semi-rotary unit according to claim 6, wherein the correction factor is determined from an algorithm which is based on the variable factors of the unit.

9. A semi-rotary unit according to claim 1, wherein a correction factor is determined for each of a range of diameters of rotary cylinder and is stored in a look-up table to be accessed when a plate manufactured for use on a rotary cylinder having a diameter other than that of the unit is used.

10. A semi-rotary unit according to claim 9, wherein the correction factor for each diameter of rotary cylinder is determined by empirical measurement.

11. A semi-rotary unit according to claim 10, wherein the control means is provided with means for effecting a fine adjustment of the speed of the rotary cylinder relative to the sheets or continuous web to accommodate diameters which fall between the values stored in the look up table.

12. A semi-rotary unit according to claim 1, wherein the correction factor is determined from an algorithm which is based on the variable factors of the unit.

13. A semi-rotary unit according to claim 12, wherein variable factors may include any combination of the following parameters:

i) the diameter of the rotary cylinder for which the plate was originally manufactured for use with;

ii) the height or thickness of the plate;

iii) the axial length of the plate; and vi) the thickness of the sheets or web.

14. A semi-rotary unit according to claim 12, wherein the correction factor is obtained by determining:

a) a first disproportion value of the plate pertaining to the rotary cylinder the plate was originally manufactured for use on;

b) the plate length after applying the first disproportion value;

c) a second disproportion value of the plate pertaining to the rotary cylinder of the unit;

d) the plate length after applying the second disproportion value;

e) the proportion of the rotary cylinder of the unit covered by the plate;

f) the compensated cylinder circumference;

and finally subtracting the cylinder circumference of the unit from the compensated cylinder circumference.

15. A process for operating a semi-rotary unit for continuously cutting or printing articles from sheets or from a continuous web, the process comprising:

a) passing said sheets or web sequentially through a rotary cutting or printing station having a rotary cylinder for supporting about its circumference a removable plate b) determining a correction factor for plates which are originally manufactured for use on a rotary cylinder having a different diameter to that of the unit; and c) varying the speed of the rotary cylinder relative to the sheets or continuous web in accordance with the correction factor.

16. A semi-rotary unit for continuously cutting or printing articles from sheets or from a continuous web, the semi-rotary unit comprising:

i) a rotary cylinder for supporting about its circumference a removable plate and defining a cutting or printing station;

ii) a conveyor for sequentially conveying sheets or a continuous web past the rotary cylinder;

iii) a motor drivingly connected to the rotary cylinder and the conveyor;

vi) means for providing a correction factor for plates which are originally manufactured for use on a rotary cylinder having a different diameter to that of the unit; and v) a controller for varying the speed of the rotary cylinder relative to the sheets or continuous web in accordance with the correction factor.

* * * * *